US009810393B2

(12) United States Patent
Gloss et al.

(10) Patent No.: US 9,810,393 B2
(45) Date of Patent: Nov. 7, 2017

(54) MOTOR VEHICLE LIGHT DEVICE INCLUDING LIGHT GUIDE AND FLAT ELECTROLUMINSSCENCE DIODE

(71) Applicant: Varroc Lighting Systems, s.r.o., Senov u Noveho Jicina (CZ)

(72) Inventors: Tomas Gloss, Vitkov (CZ); Jakub Hruska, Markvartovice (CZ); Tomas Mateju, Bartosovice na Morave (CZ)

(73) Assignee: Varroc Lighting Systems, s.r.o. (CZ)

( * ) Notice: Subject to any disclaimer, the term of this patent is extended or adjusted under 35 U.S.C. 154(b) by 0 days.

(21) Appl. No.: 15/248,602

(22) Filed: Aug. 26, 2016

(65) Prior Publication Data

US 2017/0059113 A1 Mar. 2, 2017

(30) Foreign Application Priority Data

Aug. 31, 2015 (CZ) ..... PV 2015-588

(51) Int. Cl.
*F21S 8/10* (2006.01)

(52) U.S. Cl.
CPC ..... *F21S 48/211* (2013.01); *F21S 48/215* (2013.01); *F21S 48/217* (2013.01); *F21S 48/225* (2013.01);
(Continued)

(58) Field of Classification Search
CPC ..... F21S 48/211; F21S 48/215; F21S 48/217; F21S 48/225; F21S 48/234; F21S 48/24;
(Continued)

(56) References Cited

U.S. PATENT DOCUMENTS 9,074,744 B2 7/2015 Tsukamoto
2005/0078486 A1 4/2005 Kawaguchi
(Continued)

FOREIGN PATENT DOCUMENTS

DE 10065020 A1 3/2002
DE 10314257 A1 10/2004
(Continued)

OTHER PUBLICATIONS

International Search Report from Corresponding PV 2015-588 dated Nov. 4, 2015 (3 pages).

*Primary Examiner* — Laura Tso
(74) *Attorney, Agent, or Firm* — Hovey Williams LLP; Joan O. Herman

(57) ABSTRACT

A light device for motor vehicles comprises a carrying housing covered by a translucent cover and an inner chamber where an optical system is mounted containing a light guide with a light guide body for guiding the light generated by the light source and its emission as a light beam through one or more output light surfaces out of the light guide, one or more flat electroluminescence diodes and a reflective element for reflection of light emitted from one or more light emitting surfaces of the flat electroluminescence diode. The electroluminescence diode is attached to the light guide. The light guide is configured to emit the light beam essentially in an optical axis direction, and the reflective element is adapted to reflect light of the electroluminescence diode to a direction that is essentially parallel to the direction of the optical axis.

15 Claims, 14 Drawing Sheets

(52) U.S. Cl.
CPC ..... *F21S 48/2212* (2013.01); *F21S 48/2243* (2013.01); *F21S 48/2262* (2013.01); *F21S 48/2268* (2013.01); *F21S 48/2281* (2013.01); *F21S 48/234* (2013.01); *F21S 48/24* (2013.01)

(58) Field of Classification Search
CPC ..... F21S 48/2212; F21S 48/2243; F21S 48/2262; F21S 48/2268; F21S 48/2281
USPC ..... 362/511
See application file for complete search history.

(56) References Cited

U.S. PATENT DOCUMENTS

| | | | | |
|---|---|---|---|---|
| 2006/0146555 | A1 | 7/2006 | Inaba | |
| 2015/0023046 | A1* | 1/2015 | Shido | H01L 25/048 362/543 |

FOREIGN PATENT DOCUMENTS

| | | | |
|---|---|---|---|
| EP | 1916471 | A1 | 4/2008 |
| EP | 2071228 | A2 | 6/2009 |
| EP | 2161494 | A1 | 3/2010 |
| EP | 2296025 | A2 | 3/2011 |
| EP | 2390137 | A1 | 11/2011 |
| FR | 2934353 | A1 | 1/2010 |

* cited by examiner

MOTOR VEHICLE LIGHT DEVICE INCLUDING LIGHT GUIDE AND FLAT ELECTROLUMINSSCENCE DIODE

CROSS-REFERENCE TO RELATED APPLICATIONS

This non-provisional patent application claims priority to Czech Patent Application No. PV 2015-588, filed Aug. 31, 2015, entitled "A LIGHT DEVICE, ESPECIALLY A SIGNAL LAMP FOR MOTOR VEHICLES," the entirety of which is herein incorporated by reference into this non-provisional patent application.

BACKGROUND OF THE INVENTION

1. Field of the Invention

The invention relates to a light device, such as a signal lamp for motor vehicles. Thus, the invention is directed to the field of design of signal lamps, such as those of motor vehicles, and relates to a light device fitted with lighting units to provide various light functions.

2. Description of the Related Art

A lamp for motor vehicles generally contains multiple lighting units, with each of these lighting units providing a different light function or contributing to ensuring the required emission characteristic of the output light trace. Individual lighting units are generally mounted in a shaped carrying housing of the lamp and each unit contains at least one light source and other optical elements. The light source emits light rays and the optical elements represent a system of refractive and reflective surfaces and interfaces of optical environments that influence the direction of light rays within the creation of the output light trace.

The document EP2161494 discloses the design of a front signal lamp for motor vehicles adapted to provide various light functions as the day light, positional light, and directional light. The lighting device contains two light sources of different colors that are situated on a common carrier. The light emitted from the light sources is bound to a light guide fitted with an output surface for providing various light functions. A disadvantage of this design is the fact that the creation of spatial light effects or other designer elements is limited.

From the prior art, a number of designs of tail signal lamps for motor vehicles are also known, containing the brake light, rear clearance light, fog light, reverse light, and directional light or the turn indicator. However, at present the tail lamps of motor vehicles are subject to the requirement that the emitted light beams should form various patterns that produce a spatial effect. E.g., the documents EP2390137, US2005078486 and EP1916471 disclose a design of light devices wherein the spatial effect is created by means of reflection from a semipermeable mirror. A disadvantage of the above mentioned designs is the fact that the lighting devices are not designed to provide more various lighting functions and at the same time there are high requirements for the installation space necessary for incorporating the lighting device in the vehicle body.

The document U.S. Pat. No. 9,074,744 discloses a lighting device containing a transparent flat lighting body emitting light with light emitted from two output surfaces arranged against each other into reflectors in such a way that from the front view a spatial effect is produced. The flat lighting body can be equipped with several zones for providing the output light trace for a brake light and/or rear clearance light and/or directional light. A disadvantage of this design includes limited designer options, as an output light trace of an irregular shape cannot be created.

In view of the above, there is a need for a light device, such as a signal lamp for motor vehicles, that has low requirements for integration into the vehicle body, makes it possible to create spatial light patterns, or meet other design requirements for the output light trace, and at the same time is adapted to provide several lighting functions of a lamp.

SUMMARY

The above mentioned needs are fulfilled by various embodiments of the present invention, which include a light device, such as a signal lamp for motor vehicles, comprising a carrying housing covered by a translucent cover and an inner chamber, where an optical system is mounted containing a light guide with a light guide body for guiding light generated by a light source and its emission as a light beam through one or more output light surfaces out of the light guide. The light guide additionally comprises one or more flat electroluminescence diodes and a reflective element for reflection of light emitted from one or more light emitting surfaces of the flat electroluminescence diode. The electroluminescence diode is attached to the light guide, the light guide is configured to emit the light beam essentially in an optical axis direction, and the reflective element is adapted to reflect light of the electroluminescence diode to the direction that is essentially parallel to the direction of the optical axis.

In one of the embodiments of the present invention, a least one of the electroluminescence diodes is situated in the light guide in such a way that at least a part of the light generated by the electroluminescence diode leaves the light guide through a surface that does not comprise any of the output light surfaces of the light guide.

In another one of the embodiments of the present invention, at least one of the electroluminescence diodes is attached to the light guide from the outside.

In some embodiments, the light device advantageously contains a collimating segment and/or a reflective surface situated in the light guide, adapted to direct light in the light guide.

In some embodiments, the light device advantageously contains an optical element for dispersion of light rays after their exit from the light guide through the output light surface or surfaces of the light guide.

In one of the embodiments of the present invention, the light guide is fitted with a cap from the outside to provide a required shape of the surface from which the light produced by the electroluminescence diode is emitted onto a reflective element. At the side facing the reflective element, the cap advantageously covers an anode electric outlet and an cathode electric outlet of the electroluminescence diode.

In another one of the embodiments of the present invention, the cap covers the outer surface of the light guide except the surfaces designed for emission of the light produced by the electroluminescence diode or diodes onto the reflective element.

In another one of the embodiments of the present invention, the cap is fitted with a cathode circuit and/or an anode circuit that comprise contacts situated on the inner surface of the cap for the connection of the anode electric outlet and the cathode electric outlet of the electroluminescence diodes to the conductors. The cathode circuit and/or the anode circuit are situated either completely on the cap surface or their part or parts are situated inside the cap body.

In one of the embodiments of the present invention, the light guide is fitted with a cathode circuit and/or an anode circuit that comprise contacts situated on the inner surface of the light guide for the connection of the anode electric outlet and the cathode electric outlet of the electroluminescence diodes to the conductors, with the cathode circuit and/or the anode circuit being situated either completely on the light guide surface or their part or parts are situated in the inner space of the light guide.

In some embodiments, the reflective element is advantageously spatially shaped to create the required shape of the output light surface and/or create dimensional or visual effects on the output light surface.

In some embodiments, the lighting element is advantageously adapted to create varicolored light traces wherein two light sources situated next to each other emit a light beam of a different color and/or the at least one light source contains at least two chips to produce light beams of different colors.

In some embodiments, the light sources may be mounted on one printed-circuit board attached to a carrier.

In one of the embodiments of the present invention, the lighting element and/or electroluminescence diode are connected to a control unit to ensure the required output characteristics of the output light trace and the output light surface. The light sources and/or the electroluminescence diodes are alternately or commonly controllable by the electric control unit to provide the functions of daytime lighting and/or position light and/or fog light and/or reverse light and/or directional light and/or rear clearance light and/or front clearance light.

In some embodiments, the reflective element advantageously contains at least two reflective units.

In some embodiments, a covering mask is advantageously situated in the inner chamber.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are clarified in more detail with references to the attached drawings where:

FIG. 1 shows a perspective view of an optical system of a light device according to a first embodiment of the present invention;

FIGS. 2*a* and 2*b* show top views of a part of the light device from FIG. 1 in the A direction and perpendicularly to the A direction, respectively;

Figure 1:
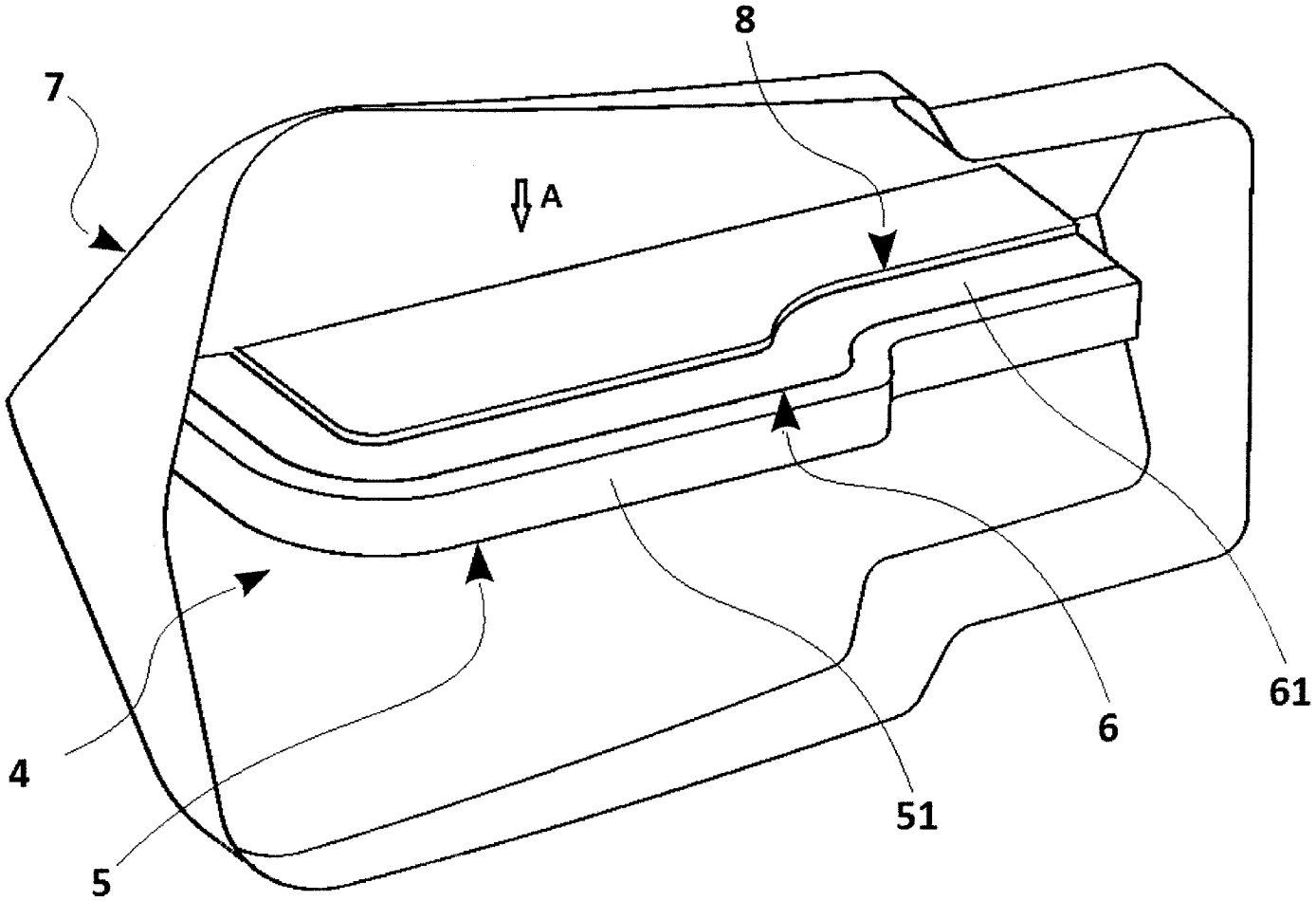
Figure 2A:
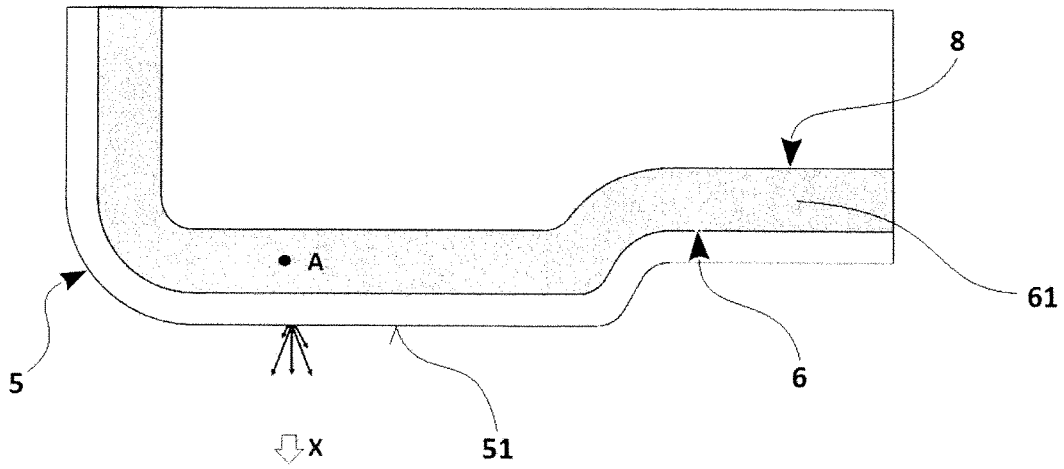
Figure 2B:
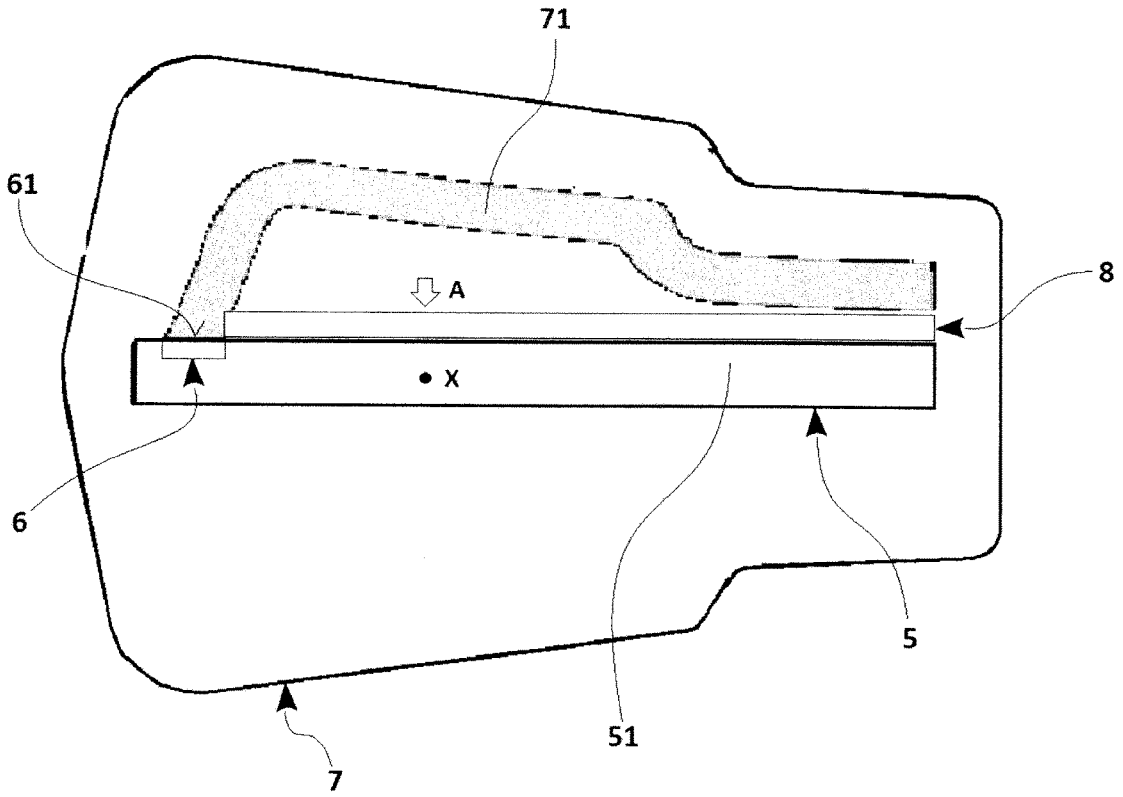
Figure 3:
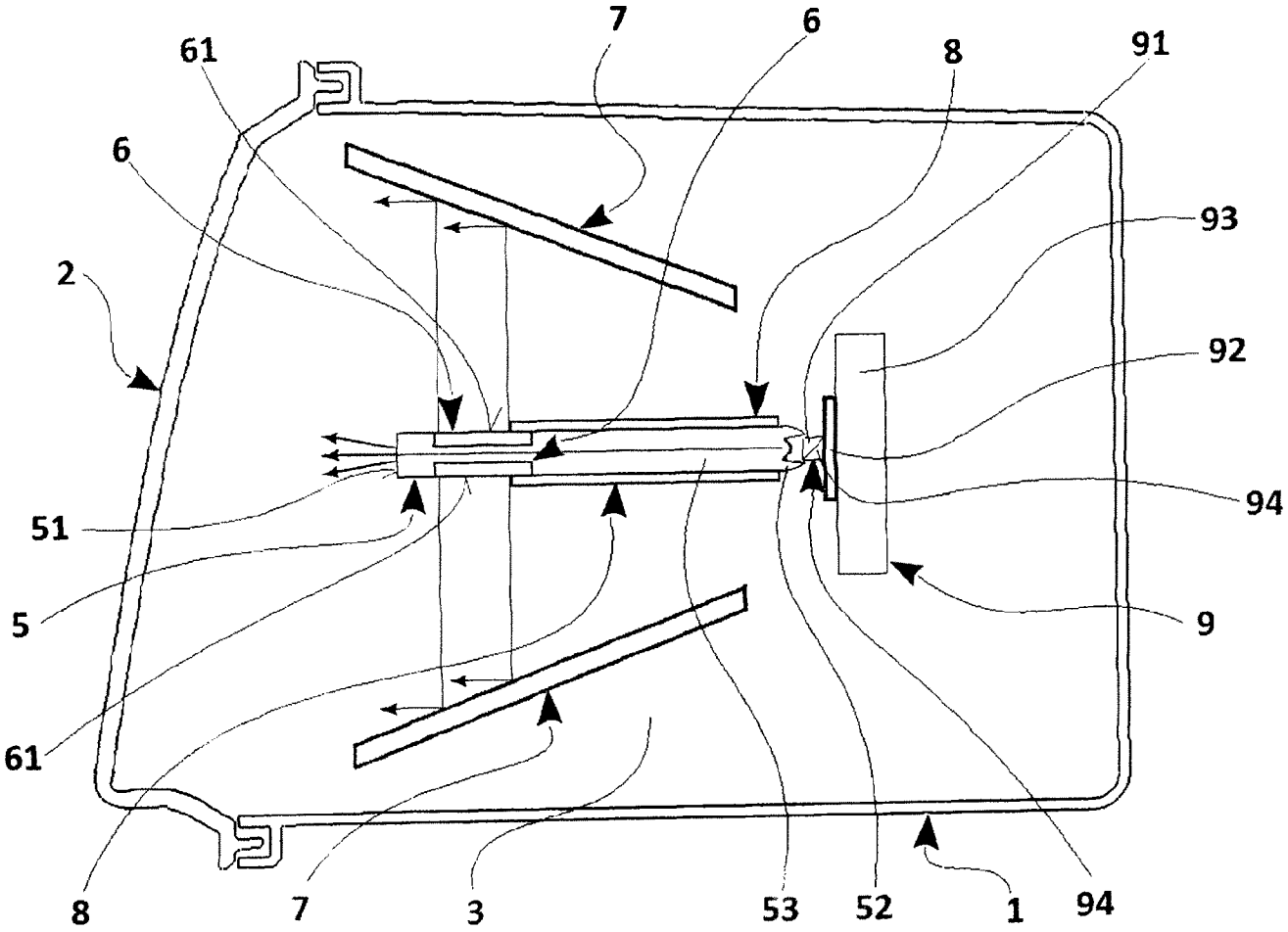
FIG. 3 shows an inner arrangement of the light device from FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

As used throughout, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

With reference to FIG. 1, FIG. 2*a*, FIG. 2*b* and FIG. 3, a light device in accordance with a first embodiment of the present invention is illustrated comprising a carrying housing 1 (See FIG. 3) covered by a translucent cover 2 (See FIG. 3) and an internal chamber 3 (See FIG. 3) of the lamp wherein an optical system 4 (See FIG. 1) is mounted. The optical system 4 comprises a light guide 5 that is fitted with at least one outlet light surface 51 in the direction of the optical axis X (See FIG. 2*a*). At the side facing the lighting element 9 (See FIG. 3), the light guide 5 is fitted with a collimating segment 52 for emission of the light beam to the body 53 of the light guide 5 in the direction of the optical axis X (See FIG. 2*a*). The lighting element 9 (See FIG. 3) comprises a light source 91 situated on a printed-circuit board 92 attached to a carrier 93.

Flat-shaped electroluminescence diodes 6, e.g., organic light-emitting diodes ("OLED"), are seated in the light guide 5 at the sides facing the reflective element 7, which may be reflectors. To prevent propagation of parasitic or undesired light, the light guide 5 is fitted with a cap 8 at the side facing the reflective element 7, and the electroluminescence diodes 6 are situated in the light guide 5 in such a way that the emitting light surface 61 advantageously creates a certain stylistic element. From the emitting light surface 61, light is emitted onto the reflective element 7 where light is reflected in the direction that is parallel to the optical axis X (See FIG. 2*a*)—this direction is essentially equal to the driving direction of the vehicle with which the light device is associated.

To achieve other designer elements, the entire reflective element 7 can be spatially shaped in such a way that the output light trace 71 (See FIG. 2*b*) exiting from the reflective element 7 in the direction parallel to the optical axis X (See FIGS. 2*a* and 2*b*) does not correspond the shape of the light emitted from light surface 61 exiting from the electroluminescence diodes 6.

Figure 4:
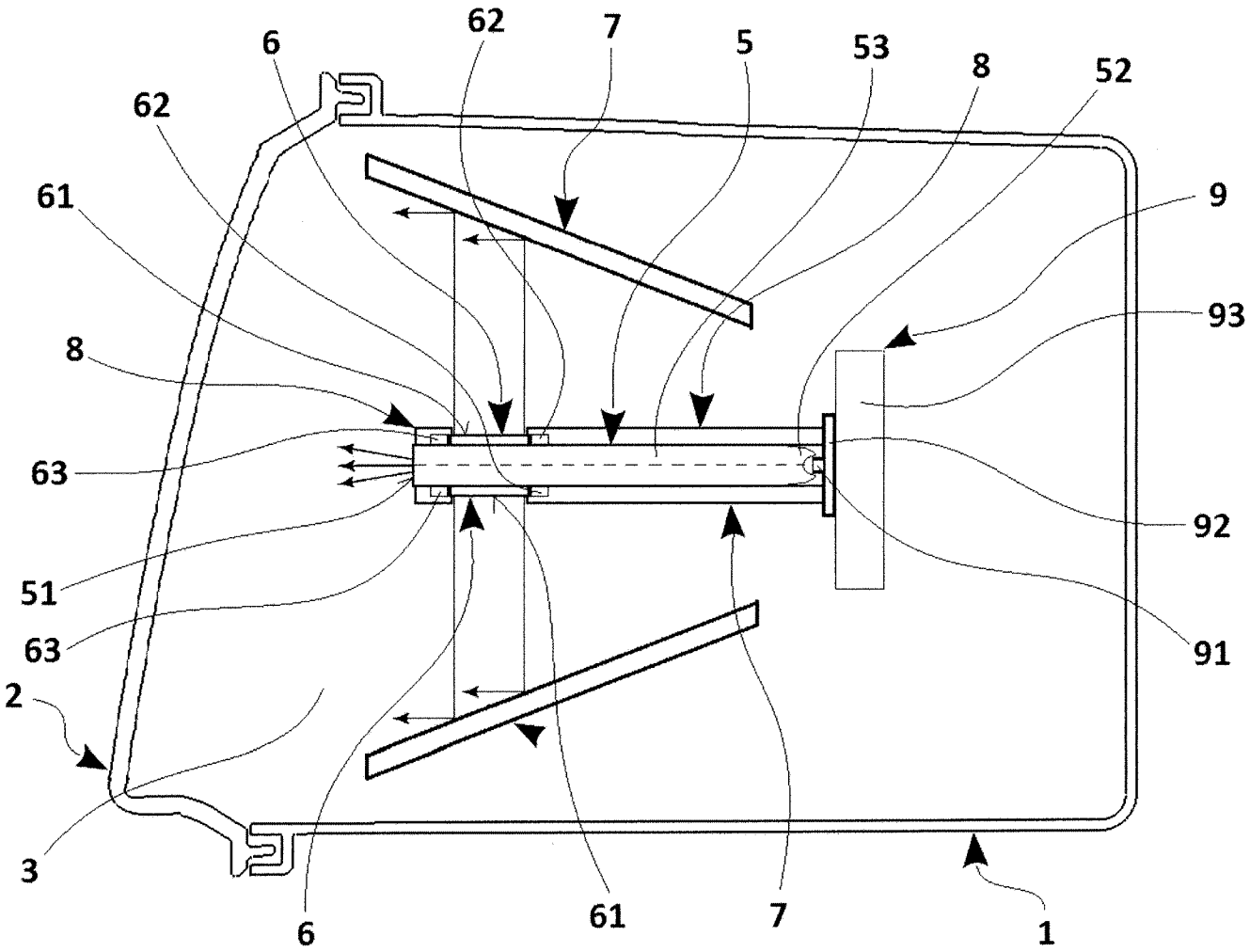
FIG. 4 and FIG. 5 show an internal arrangement of an optical system of a light device according to a second and a third embodiment of the present invention, respectively.

FIG. 4 shows a second exemplary embodiment of a lighting device in which the electroluminescence diode 6 has a light emitting surface 61 and anode electric outlets 62 and cathode electric outlets 63 for the connection to the power supply. The electric outlets 62, 63 do not emit light and are covered by the cap 8.

Figure 5:
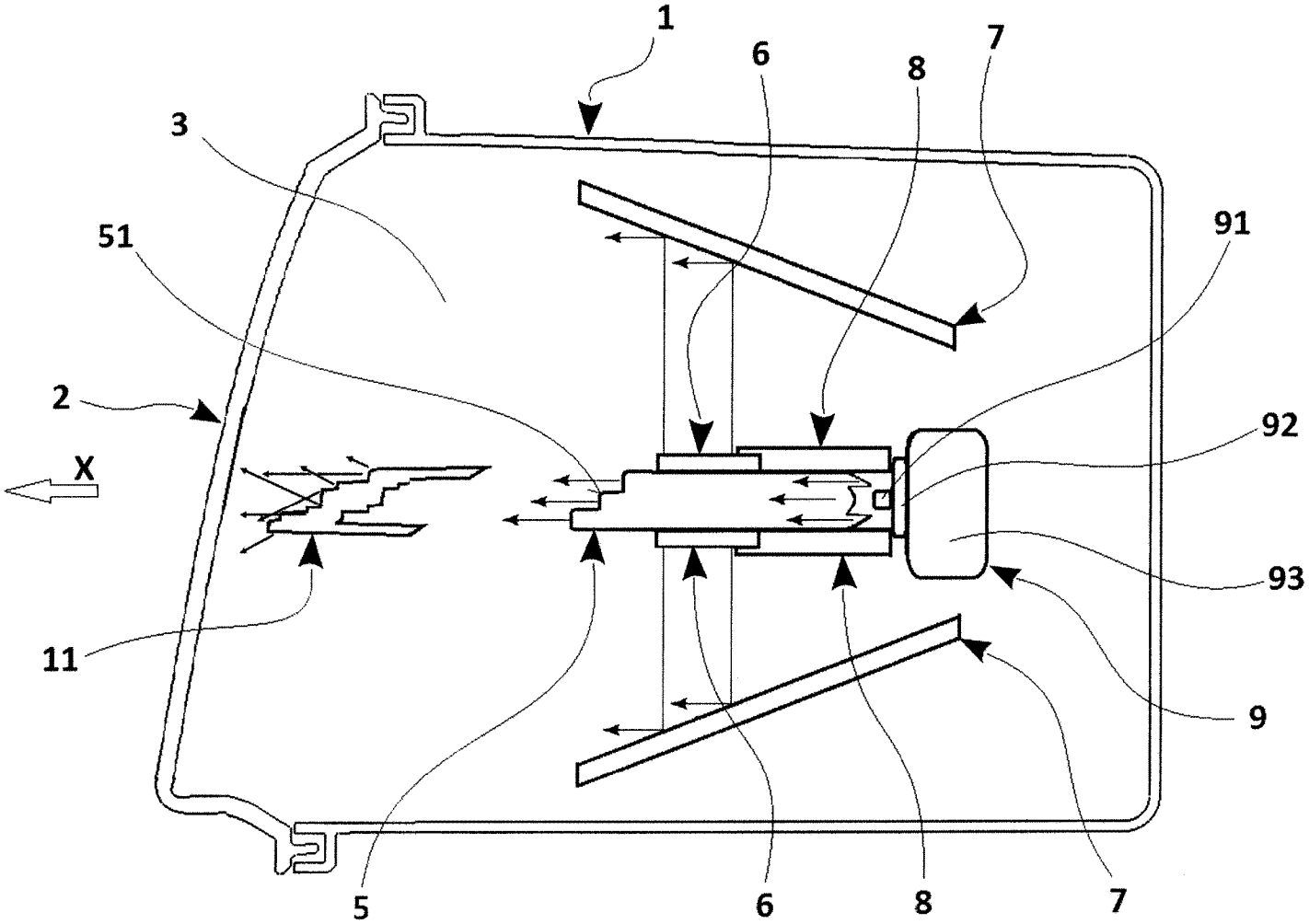

FIG. 5 shows a third exemplary embodiment of a lighting device where the light guide 5 is adapted to collimate light rays in the direction of the optical axis X. The required output characteristic is achieved through a separate optical element 11 that ensures emission/dispersion of light rays into the desired direction.

Figure 7:
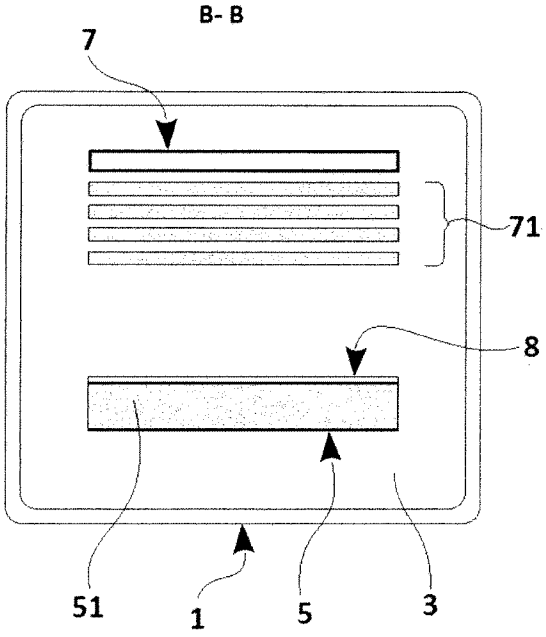
FIG. 7 shows a front view of the light device from FIG. 6.
Figure 6:
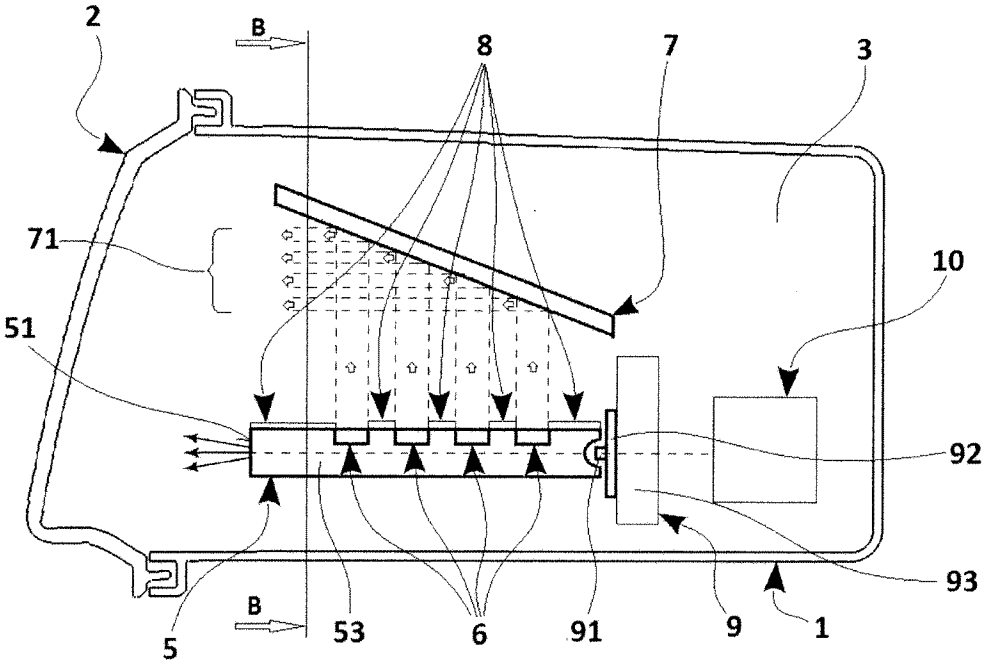
FIG. 6 shows an internal arrangement of an optical system of a light device according to a fourth embodiment of the present invention.

FIG. 6 and FIG. 7 show a fourth exemplary embodiment of a lighting device, with the electroluminescence diodes 6 situated next to each other at a certain distance. The lighting element 9 is connected to a control unit 10. Through the reflective element 7, 3D dimensional/visual effects can be achieved for the output light trace 71 within the provision of the red brake and rear clearance light. The output light surface 51 of the light guide 5 then provides an amber directional light.

Figure 9:
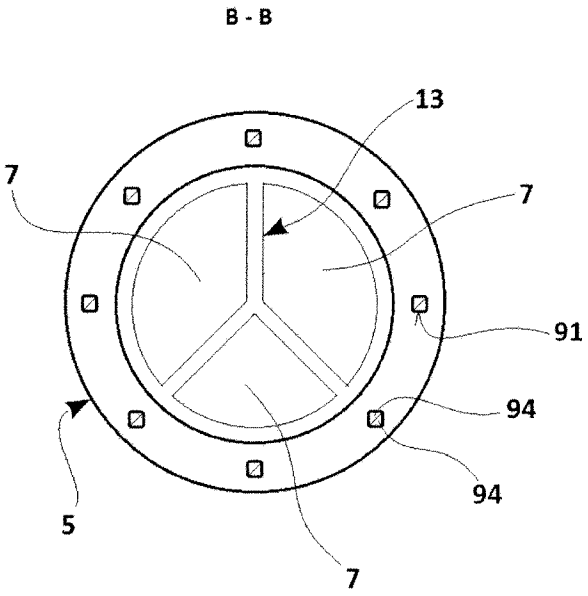
FIG. 9 shows a front view of the light device from FIG. 8.
Figure 8:
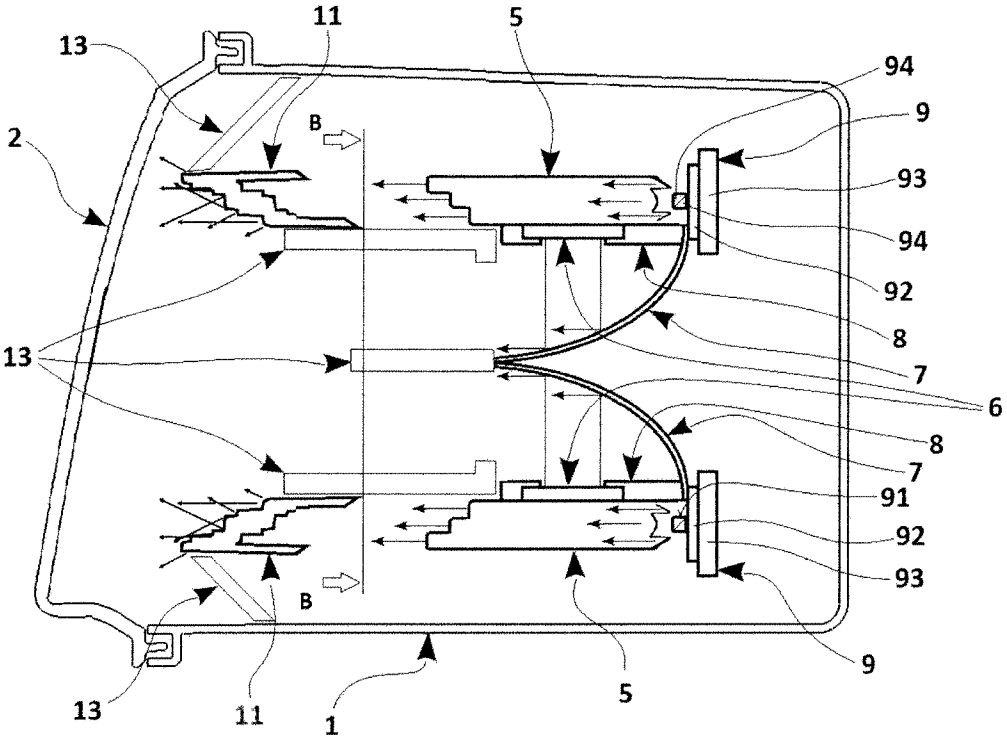
FIG. 8 shows an internal arrangement of an optical system of a light device according to a fifth embodiment of the present invention.

FIG. 8 and FIG. 9 show a fifth exemplary embodiment of a lighting device, with the light guide 5 being of a circular or oval shape and the light emitting surfaces from the electroluminescence diodes 6 facing the inner chamber where three reflective units of reflective element 7 comprising a parabolic shape are situated. The lighting element 9 contains light sources 91 designed to emit white and/or amber and/or red light. Also, the electroluminescence diodes 6 are implemented in the form of a warped plate and are designed to emit white and/or amber and/or red light.

Figure 10:
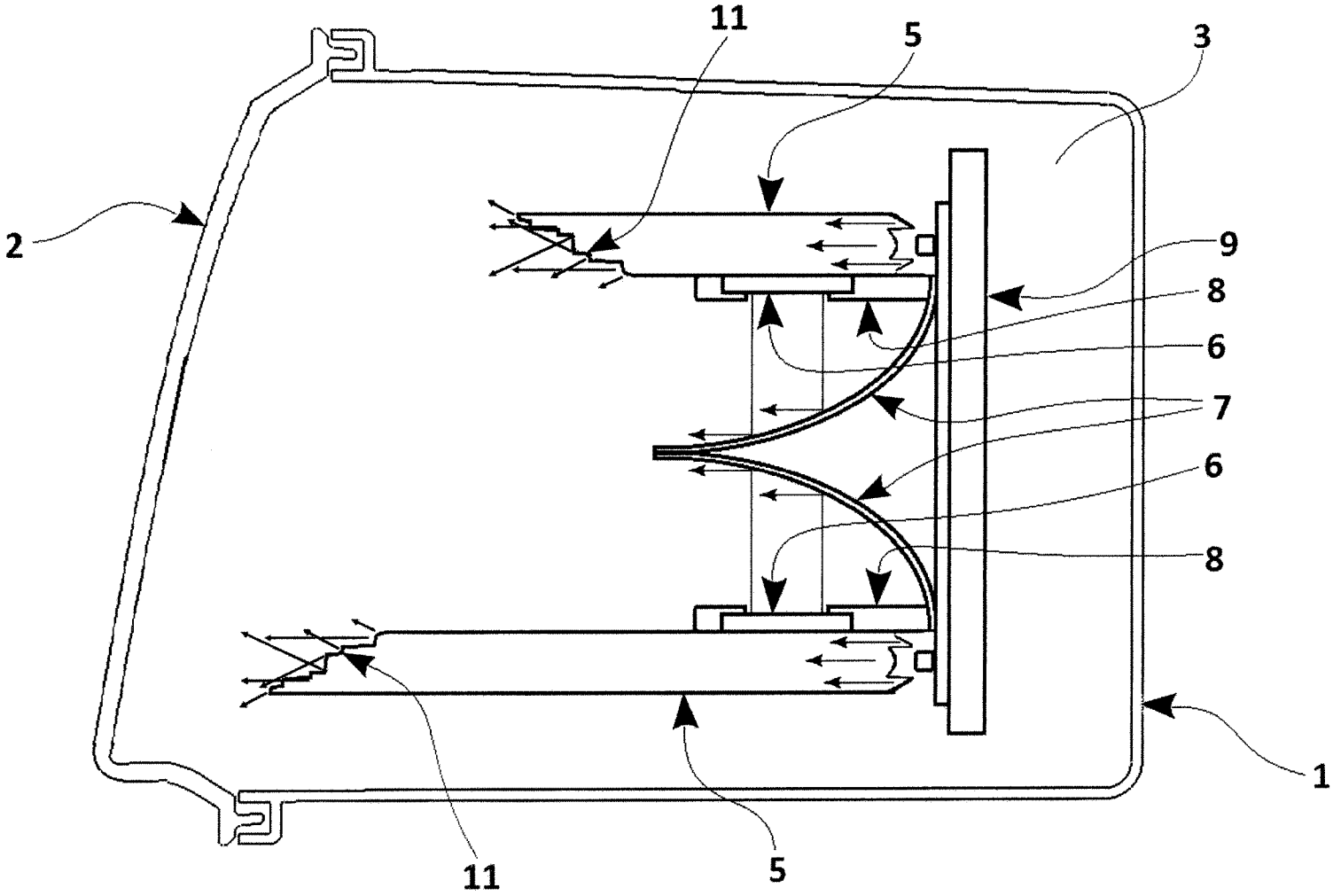
FIG. 10 shows an internal arrangement of an optical system of a light device according to a sixth embodiment of the present invention.

FIG. 10 shows a sixth exemplary embodiment of a lighting device, with the light guide 5 equipped at the output side with an optical element 11 for dispersion of light rays into the required direction.

Figure 11:
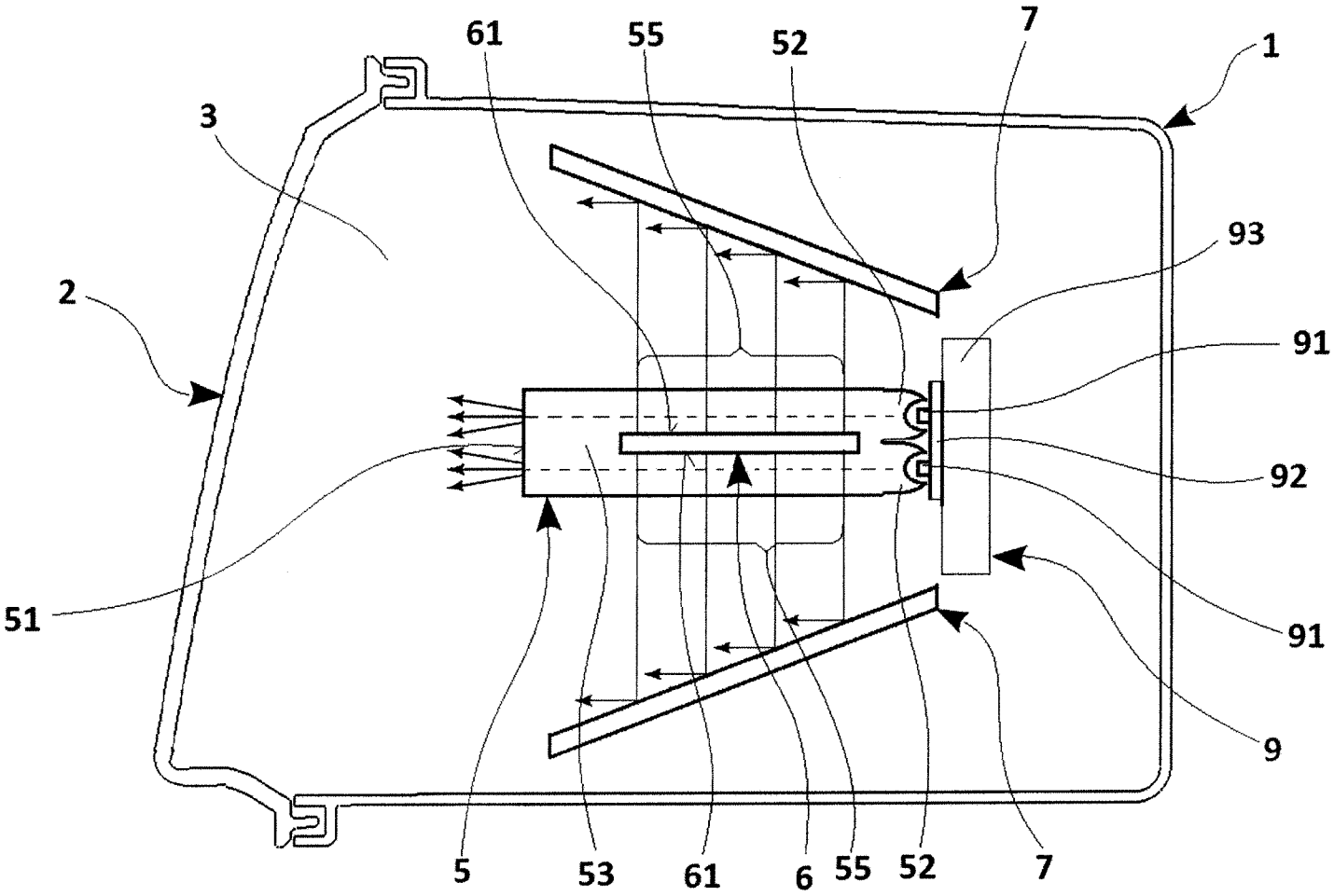
FIG. 11 shows an internal arrangement of an optical system of a light device according to a seventh embodiment of the present invention.

FIG. 11 shows a seventh exemplary embodiment of a lighting device, with one electroluminescence diode 6 being equipped with two light emitting surfaces 61, and the electroluminescence diode 6 being integrated in the body 53 of the light guide 5 in such a way that the light emitted from the electroluminescence diode 6 first passes through the body 53 of the light guide 5 and it is only then that it is directed by the reflective element 7 to the required direction, i.e. direction of the optical axis X. In this embodiment, the light guide 5 is equipped with two collimating segments 52 situated over each other.

Figure 13:
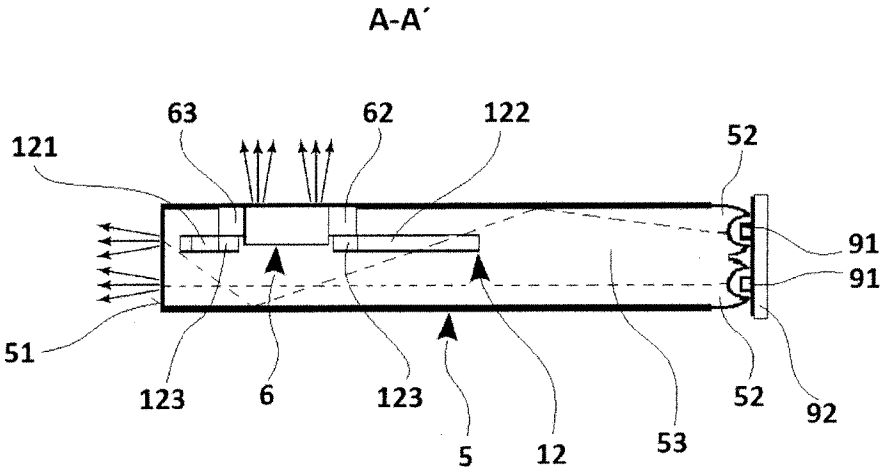
FIGS. 12 and 13 show a first exemplary arrangement of a cathode circuit and an anode circuit using a light guide cap according to embodiments of the present invention.
Figure 12:
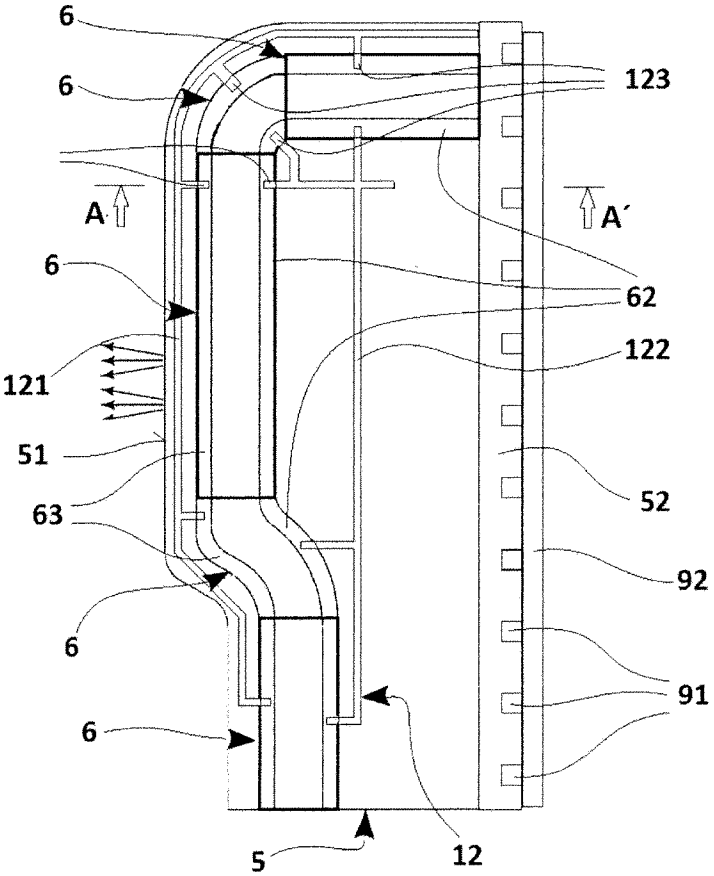

FIG. 12 and FIG. 13 show an exemplary arrangement of a cathode circuit 121 and an anode circuit 122. The light guide 5 fulfils the function of the holder of five electroluminescence diodes 6 fitted on their perimeter with anode and cathode electric outlets 62, 63 for the connection to the conductors 12 that comprise a cathode circuit 121 and anode circuit 122, part of which being contacts 123 situated on the surface of the body 53 of the light guide 5 for the connection of the respective electric outlets 62, 63 of the electroluminescence diodes 6. The cathode circuit 121 and/or the anode circuit 122 are situated either completely on the light guide surface and/or their part or parts are situated inside the body 53 of the light guide 5.

Figure 14:
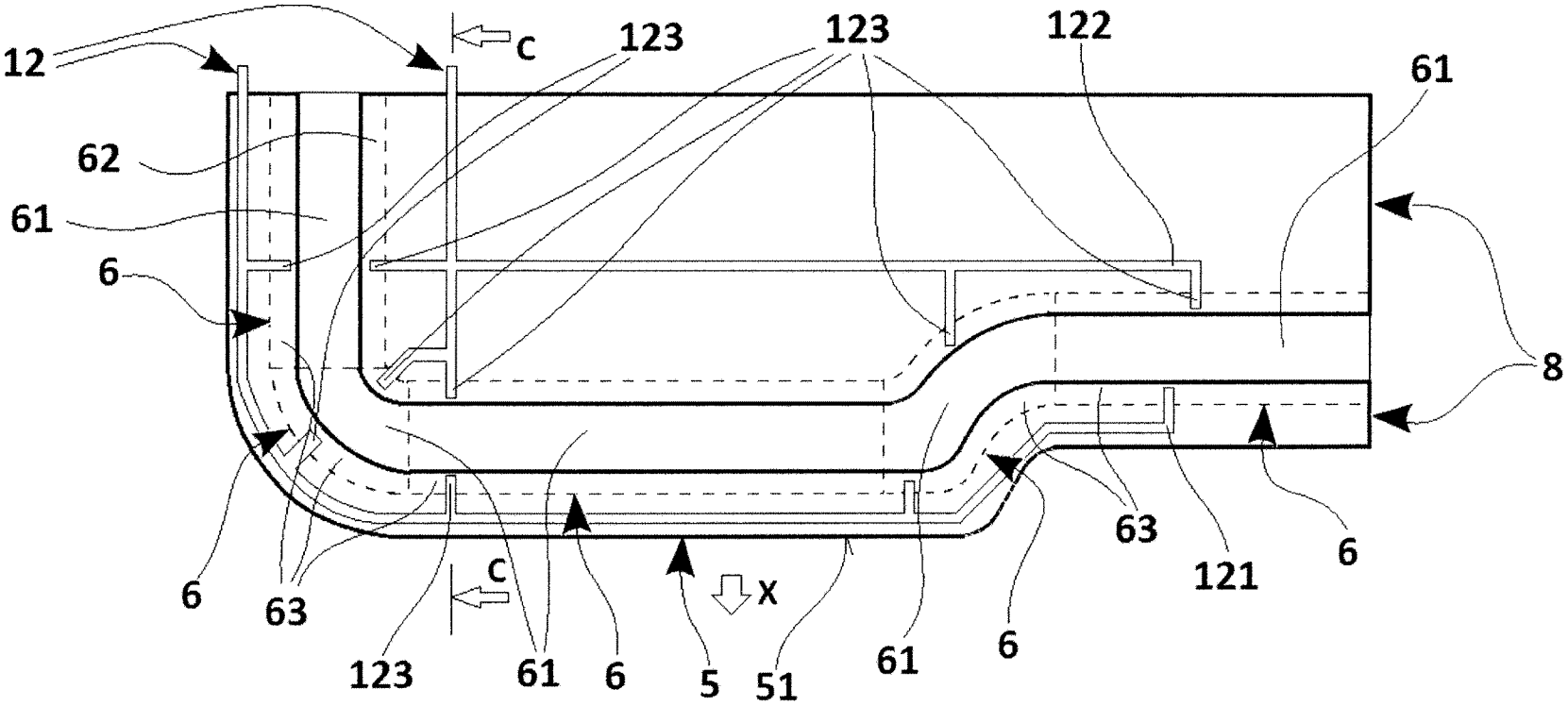
FIGS. 14 and 15 show a second exemplary arrangement of a cathode circuit and an anode circuit using a light guide cap according to embodiments of the present invention.
Figure 15:
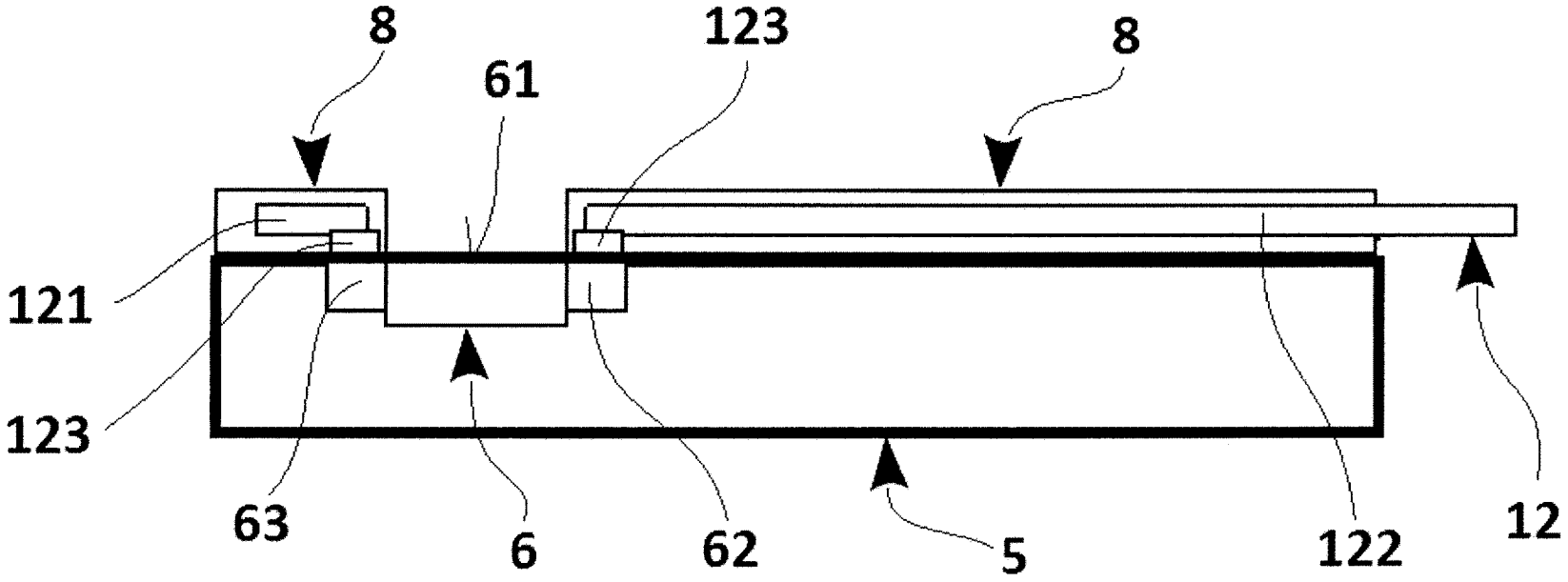

FIG. 14 and FIG. 15 show an additional exemplary arrangement of a cathode circuit 121 and an anode circuit 122. The cap 8 is fitted with the cathode circuit 121 and the anode circuit 122, which comprise contacts 123 situated on the inner surface of the cap 8 for the connection of the respective electric outlets 62, 63 of the electroluminescence diodes 6 to the conductors 12. The cathode circuit 121 and/or the anode circuit 122 are situated either completely on the surface of the cap 8 and/or their part or parts are situated in the inner space of the cap 8.

Figure 16:
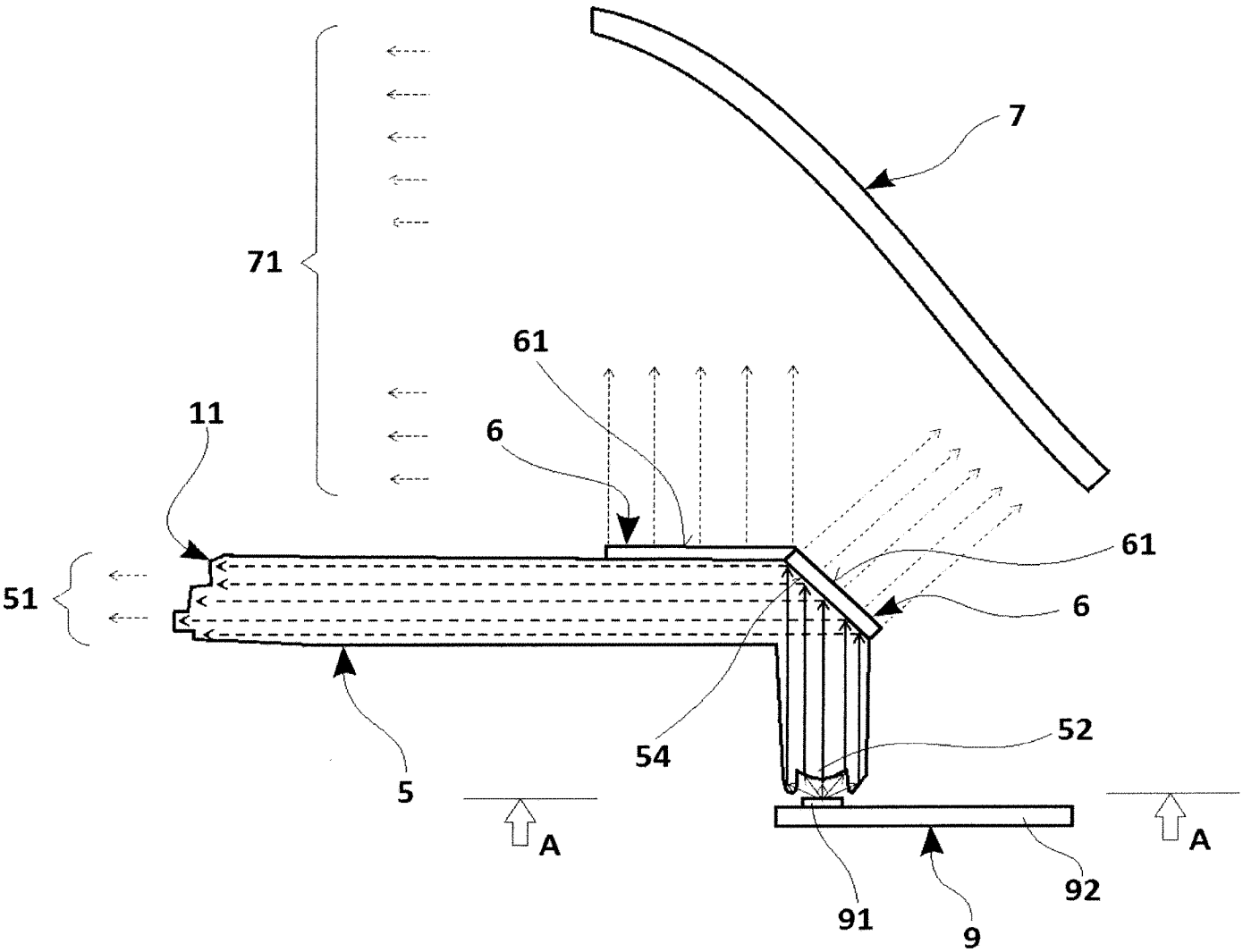
FIG. 16 shows an internal arrangement of an optical system of a light device according to an eighth embodiment of the present invention, with the light system using a collimation segment and a reflection surface.
Figure 17:
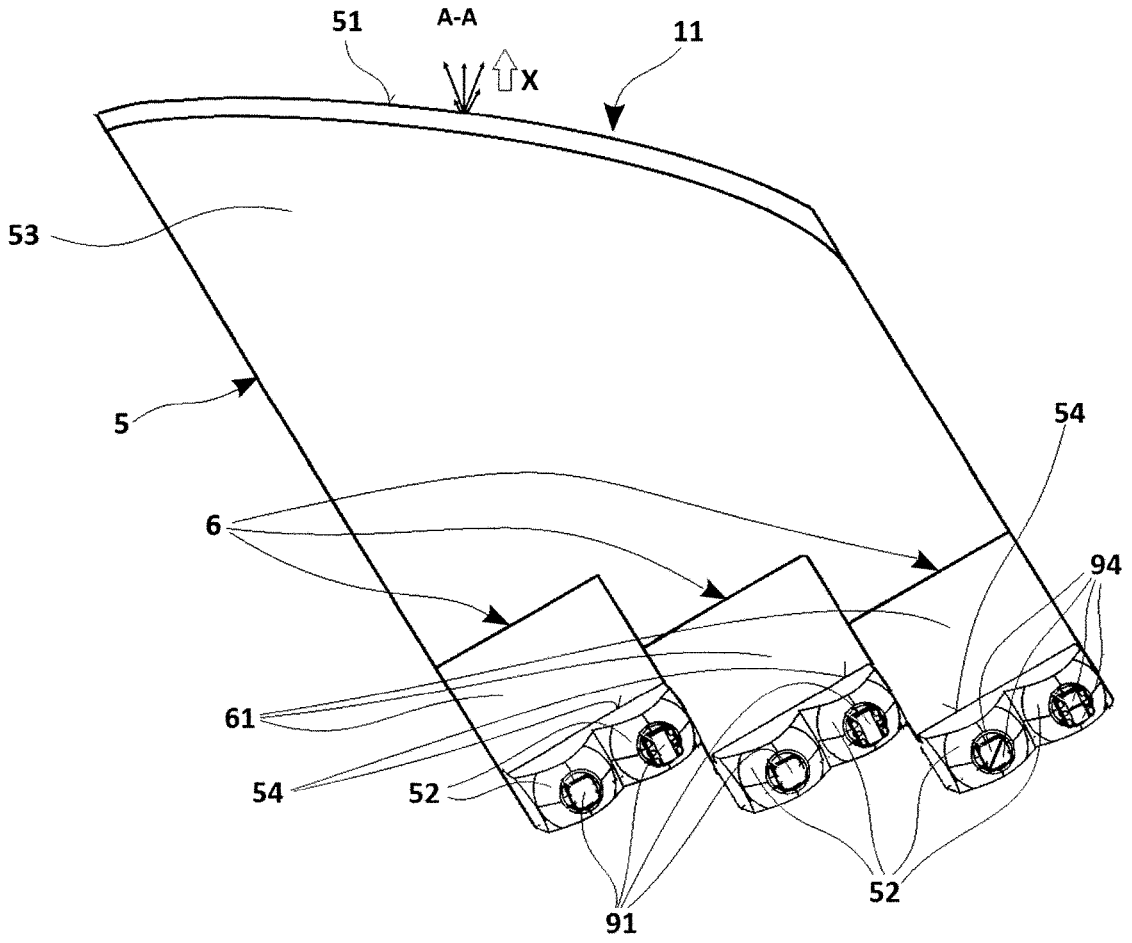
FIG. 17 shows a schematic view of the optical system using the arrangement from FIG. 16.

FIG. 16 and FIG. 17 show an eighth exemplary embodiment of a lighting device, where the light guide 5 is fitted in its inlet part with collimating segments 52 binding the light from the light source 91. In the body 53 of the light guide 5 an inner reflective surface 54 is created to reflect the light beams emitted by the lighting element 9 and at the output light surface 51 an optical element 11 is situated that is adapted to disperse light to the required direction. The output light trace 71 leaving the reflective element 7 is created by the two light emitting surfaces 61, one electroluminescence diode 6 emitting a light beam perpendicularly to the direction of the optical axis X and the other electroluminescence diode 6 emitting a light beam at an angle to the direction of the optical axis X.

The electroluminescence diode 6 emits yellow and/or red and/or white light and two electroluminescence diodes 6 situated next to each other emit a light beam of the same or different color. With reference to FIG. 17, the lighting element 9 emitting, through the light sources 91, yellow and/or red and/or white light contains one light source 91 at one collimating segment 52 and two light sources 91 situated next to each other emit a light beam of a different color. Further, an embodiment is possible wherein one of the light sources 91 contains two or more chips 94 to create two and more varicolored light beams. All the light sources 91 are advantageously mounted on one printed-circuit board 92 attached to the carrier 93. The carrier 93 may be designed as a cooler for dissipation of heat generated by the light sources 91. The light sources 91 are situated at the collimating segments 51 in such a way that the light beam of the white color or yellow color or red color is guided through the entire body 53 of the light guide 5 to the output light surface 51.

The lighting element 9, or possibly the electroluminescence diodes 6 are preferably connected to a control unit 10 and the light sources 91 and electroluminescence diodes 6 with various light functions are alternately or commonly controllable by the electronic control unit 10 in such a way that the electronic control unit 10 switches pre-defined light sources 91 and flat electroluminescence diodes 6 in such a way as to ensure the desired output characteristic of the output light trace 71 and the output light surface 51, i.e. the color and intensity of the output light. Thus, in front signal lamps the functions of white light for daytime lighting, position light, fog light or reverse light can be combined, further the function of yellow/amber light to provide directional light and further the function of red light to create a rear clearance light or red brake light.

The described and displayed embodiments do not represent the only possible design of the light device—the electroluminescence diodes 6 and/or the light sources 91 can be adapted to provide other indication functions when the emitted light has the blue and/or green color.

LIST OF REFERENCE MARKS

1—carrying housing
2—translucent cover
3—inner chamber
4—optical system
5—light guide
6—electroluminescence diode
7—reflective element
8—cap
9—lighting element
10—control unit
11—optical element
12—conductors
13—covering mask
51—output light surface
52—collimating segment
53—body
54—inner reflective surface
55—peripheral surface
61—light emitting surface
62—anode electric outlet
63—cathode electric outlet
71—output light trace
72—reflective unit
91—light source
92—printed-circuit board
93—carrier
94—light emitting chip
121—cathode circuit
122—anode circuit
123—contacts Although the invention has been described with reference to the embodiments illustrated in the attached drawing figures, it is noted that equivalents may be employed and substitutions made herein without departing from the scope of the invention as recited in the claims.

The invention claimed is:

1. A light device for motor vehicles, the light device comprising:

a carrying housing covered by a translucent cover and including an inner chamber where an optical system is mounted, wherein the optical system includes— a light guide with a light guide body for guiding a light beam generated by a light source, wherein the light guide body guides the light beam out of the light guide through one or more output light surfaces of the light guide, one or more flat electroluminescence diodes, and a reflective element for reflection of light emitted from one or more light emitting surfaces of the flat electroluminescence diode, wherein at least one of the flat electroluminescence diodes is attached to the body of the light guide, wherein the light guide is configured to emit the light beam generated by the light source substantially in an optical axis direction of the light device, and the reflective element is adapted to reflect light generated by the flat electroluminescence diode in a direction that is substantially parallel to the direction of the optical axis.

2. The light device according to claim 1, wherein at least one of the flat electroluminescence diodes is attached to an outside of the body of the light guide or is integrated in a peripheral wall of the body of the light guide such that the light emitting surface of the flat electroluminescence diode forms a part of a surface of the light guide.

3. The light device according to claim 1, wherein at least one of the flat electroluminescence diodes is integrated in the body of the light guide such that light from the light emitting surface of the flat electroluminescence diode is configured to exit from the light guide through a peripheral surface of the light guide.

4. The light device according to claim 1, wherein the light device includes a collimating segment or a reflective surface situated in the light guide and adapted for directing the light in the light guide.

5. The light device according to claim 1, wherein the light device includes an optical element for dispersion of the light beam after the light beam exits from the light guide through the output light surface of the light guide.

6. The light device according to claim 1, wherein the light guide is fitted with a cap on the outside of the light guide, wherein the cap is configured to provide a required shape of a surface of the light guide from which the light produced by the electroluminescence diode is emitted onto the reflective element.

7. The light device according to claim 6, wherein at a side of the cap facing the reflective element, the cap covers an anode electric outlet and a cathode electric outlet of the electroluminescence diode.

8. The light device according to claim 7, wherein the cap is fitted with a cathode circuit and an anode circuit that comprise contacts situated on an inner surface of the cap for the connection of the anode electric outlet and the cathode electric outlet of the electroluminescence diodes to the conductors, wherein the cathode circuit and the anode circuit are situated either completely on a surface of the cap or inside a body of the cap.

9. The light device according to claim 7, wherein the light guide is fitted with a cathode circuit and an anode circuit that comprise contacts situated on an inner surface of the light guide for the connection of the anode electric outlet and the cathode electric outlet of the electroluminescence diodes to the conductors, wherein the cathode circuit and the anode circuit are situated either completely on a surface of the light guide or in an inner space of the light guide.

10. The light device according to claim 1, wherein the reflective element is spatially shaped to create a required shape of an output light trace from the reflective element or to create dimensional or visual effects for the output light trace.

11. The light device according to claim 1, wherein the light device includes at least two light sources situated next to each other for emission of light beams of different colors, or at least one light source contains at least two chips for emission of light beams of different colors.

12. The light device according to claim 11, wherein the light sources are mounted on one printed-circuit board attached to a carrier.

13. The light device according to claim 1, wherein the lighting element or the electroluminescence diode are connected to a control unit configured to provide required output characteristics of the output light trace from the reflective element and the output light surface of the light guide, wherein the light sources or the electroluminescence diodes are alternately or commonly controllable by the electric control unit to provide the functions of daytime light, position light, fog light, reverse light, directional light, rear clearance light, or front clearance light.

14. The light device according to claim 1, wherein the reflective element contains at least two reflective units.

15. The light device according to claim 1, wherein a covering mask is situated in the inner chamber.

* * * * *